US006676011B2

(12) United States Patent
Luu et al.

(10) Patent No.: US 6,676,011 B2
(45) Date of Patent: Jan. 13, 2004

(54) PACKAGING BOX

(76) Inventors: Tom Luu, 232 Beegum Way, San Jose, CA (US) 95123; Ana Luu, 232 Beegum Way, San Jose, CA (US) 95123

( * ) Notice: Subject to any disclaimer, the term of this patent is extended or adjusted under 35 U.S.C. 154(b) by 156 days.

(21) Appl. No.: 09/969,696

(22) Filed: Oct. 3, 2001

(65) Prior Publication Data

US 2003/0062405 A1 Apr. 3, 2003

(51) Int. Cl.[7] ..... B65D 5/56
(52) U.S. Cl. ..... 229/117.33; 206/521
(58) Field of Search ..... 206/424, 521, 206/594, 522, 521.2, 521.6; 229/125.38, 125.21, 117.33

(56) References Cited

U.S. PATENT DOCUMENTS

| | | | | | |
|---|---|---|---|---|---|
| 443,397 | A | * | 12/1890 | Mack | 229/125.38 |
| 2,956,672 | A | | 10/1960 | Kirkpatrick | |
| 3,211,283 | A | * | 10/1965 | Hassler | 206/424 |
| 3,752,301 | A | | 8/1973 | Bluemel | |
| 3,796,307 | A | | 3/1974 | McKinney | |
| 3,938,728 | A | | 2/1976 | Deards et al. | |
| RE29,721 | E | | 8/1978 | Ukmar et al. | |
| 4,133,430 | A | * | 1/1979 | Cravens | 229/125.21 |
| 4,190,158 | A | | 2/1980 | Ambrose | |
| 4,285,432 | A | | 8/1981 | de Villers et al. | |
| 4,560,090 | A | | 12/1985 | Okushita | |
| 4,757,900 | A | | 7/1988 | Misset et al. | |
| 4,865,200 | A | * | 9/1989 | Sullivan et al. | 206/583 |
| 4,889,252 | A | * | 12/1989 | Rockom et al. | 229/103.11 |
| 5,086,925 | A | | 2/1992 | Coalier et al. | |
| 5,356,028 | A | | 10/1994 | Heuberger et al. | |
| 5,820,268 | A | * | 10/1998 | Becker et al. | 383/99 |
| 6,296,134 | B1 | * | 10/2001 | Cardinale | 220/62.21 |
| 6,308,828 | B1 | * | 10/2001 | Jones | 206/583 |
| 6,443,309 | B1 | * | 9/2002 | Becker | 206/594 |

FOREIGN PATENT DOCUMENTS

| | | |
|---|---|---|
| DE | 19725499 | 12/1999 |

* cited by examiner

*Primary Examiner*—Tri M. Mai
(74) *Attorney, Agent, or Firm*—John A. Galbreath

(57) ABSTRACT

A packaging box includes a rectangularly configured box having an impact-resistant inner bag attached to a first side interior surface. The attached inner bag has an opening for inserting the article to be packaged. The inner bag is then closed about the article using tape elements. When properly closed the inner bag will be spaced from the box interior surface when the first side is facing up. An additional support for the inner bag includes tie members extending from the first side interior surface and about the closed inner bag, the tie members being joined into a twist knot, where further twisting tightens the tie members about the inner bag, thus supporting it generally and providing additional means for spacing the inner bag from the box interior surfaces when the first side is facing up.

25 Claims, 13 Drawing Sheets

PACKAGING BOX

BACKGROUND OF THE INVENTION

1. Field of the Invention

The present invention relates generally to boxes and more specifically to a packaging and storage box for shipping fragile articles.

2. Description of the Prior Art

There are other packaging boxes designed for packing items. Typical of these is U.S. Pat. No. 2,956,672 issued to Kirkpatrick on Oct. 18, 1960.

Another patent was issued to Bluemel on Aug. 14, 1973 as U.S. Pat. No. 3,752,301. Yet another U.S. Pat. No. 3,796,307 was issued to McKinney on Mar. 12, 1974 and still yet another was issued on Feb. 17, 1976 to Deards as U.S. Pat. No. 3,938,728.

Another patent was issued to Ukmar, et al. on Aug. 8, 1978 as U.S. Pat. No. Re. 29,721. Another patent was issued to Ambrose on Feb. 26, 1980 as U.S. Pat. No. 4,190,158. Another patent was issued to de Villers et al. on Aug. 25, 1981 as U.S. Pat. No. 4,285,432. Another patent was issued to Okushita on Dec. 24, 1985 as U.S. Pat. No. 4,560,090. Another patent was issued to Misset et al. on Jul. 19, 1988 as U.S. Pat. No. 4,757,900. Another patent was issued to Coalier et al. on Feb. 11, 1992 as U.S. Pat. No. 5,086,925. Another patent was issued to Heuberger et al. on Oct. 18, 1994 as U.S. Pat. No. 5,356,028. Another patent was issued to Loeffler Burkhard on Dec. 28, 1999 as U.S. Pat. No. 6,006,917.

U.S. Pat. No. 2,956,672

Inventor: Wylie C. Kirkpatrick

Issued: Oct. 18, 1960

This invention relates to packaging, and more particularly to a device for packing using a hammock pack that embodies a container such as a corrugated carton or box within and suspending the article, having ends fixed to opposite sides of the box.

U.S. Pat. No. 3,752,301

Inventor: Oscar Bluemel

Issued: Aug. 14, 1973

A shock-proof packing container for shipping fragile articles comprises a rectangular outer carton, a polygonal inner support member that is adapted to fit snugly within the outer carton and bear against all four side walls of the outer carton, and a flexible sling attached to opposing walls of the inner support member and extending therebetween. Fragile articles are wrapped in this sling and are thereby suspended in the interior of the packing container. Locking flaps are attached to the inner support member so that the position of the inner support member with respect to the outer carton remains fixed.

U.S. Pat. No. 3,796,307

Inventor: James C. McKinney

Issued: Mar. 12, 1974

This invention comprises a corrugated package material wherein the corrugated fluting is attached to one or more sheets of heat shrinkable polymeric film. The heat shrinkable film is preferably on only one side of the corrugated fluting, but may be on both sides of the corrugated fluting. This packaging material is then formed into a carton and this carton filled; or is used to bundle a series of containers, and the final assembly, whether a carton or bundle, heat shrunk, whereby the strength of the corrugate is increased.

U.S. Pat. No. 3,938,728

Inventor: Henry C. Deards

Issued: Feb. 17, 1976

A container assembly for biologically processing liquids, comprising an open-top box, a free-standing, block ended plastics-film sleeve fitted within the box, and a liquid-tight plastics-film liner, the depth of the box being not more that one-half that of the sleeve, and the sleeve preferably having a stiffening attachment or enclosure at its base, to fit the box.

U.S. Pat. No. Re. 29,721

Inventor: Luigi Ukmar

Issued: Aug. 8, 1978

A package for bulk materials having a box-like protective container and plastic bag liner, and means for securing the bag in the container by a triangularly shaped flap formed by a fold of the bag wall, said means comprising a channel member and an elongated metal strip adapted to be secured in the groove of the channel member and secure the flap therebetween, said bag also having triangularly shaped flaps for filing and emptying the bag.

U.S. Pat. No. 4,190,158

Inventor: Charles Ambrose

Issued: Feb. 26, 1980

A container for delicate articles which includes an inner envelope, and an inflatable outer envelope sealed to the ends thereof. The inner envelope is vented to the exterior of the container so that, on inflation of the outer envelope, the inner envelope is collapsed tightly about the article, which is thus suspended in and protected by the inflated outer envelope. Preferably, the inflation is accomplished within an outer protective casing, which is coated on its interior with an adhesive. Should the casing and outer envelope be punctured, the parts will then still be kept in essentially established positions.

U.S. Pat. No. 4,285,432

Inventor: Paul de Villers

Issued: Aug. 25, 1981

The present invention relates to packaging for various fragile articles, including a method and particularly relates to the packaging of fragile articles such as glass lighting fixture globes including ones commonly known as "Tiffany" types.

U.S. Pat. No. 4,560,090

Inventor: Masataka Okushita

Issued: Dec. 24, 1985

For the fabrication of a bag-in-box (BIB) package, there is first provided a semifinished, collapsed BIB package wherein a flattened bag is placed within a collapsed box and secured to at least one of its inside surfaces by means of an adhesive. After erecting the package, the bag is inflated into close internal contact with the box by introducing a gas under pressure through a fitment attached to the bag and projecting outwardly of the box. The opposite ends of the box are closed with sets of foldable end flaps, with the aid of an adhesive. Preferably, the bag is further secured to the inside surfaces of a pair of opposed ones of the four bottom end flaps of the box. The opposed pair of bottom flaps are held folded out during the introduction of the pressurized gas into the bag, in order that the bottom end portion of the inflated bag may make neat contact with the inside surfaces of the box. There is also disclosed herein an apparatus for thus fabricating the BIB package.

U.S. Pat. No. 4,757,900

Inventor: Rene Misset, et al.

Issued: Jul. 19, 1988

The present invention relates to a packing case comprising a box, a heat-retractable plastic and at least one lid, for storing, handling and transporting a charge. In the said case, the heat-retractable plastic in sheet form is bonded at one or more of its edges to the outer surface of a wall of the said box, in the vicinity of the side of the said wall, and extends, on the outside, from the said edge to the side of the said wall and then inside the box, opposite the inner surface of the said wall, moving away from the latter towards the charge which is to be packed. In the said case, the charge is held down against the bottom by means of the heat-retractable plastic along an overlapping zone.

U.S. Pat. No. 5,086,925

Inventor: Guy Coalier, et al.

Issued: Feb. 11, 1992

Packaging made of card or similar material for packing a plurality of objects, the packaging comprising a body having a ring of sides and a bottom, thereby defining a volume for receiving said objects, and at least one sheet of shrinkable synthetic material fixed to said body for covering said plurality of objects and for holding the objects in place in said volume by said sheet being shrunk, said bottom being constituted by a plurality of flaps each of which is connected via a corresponding fold line to the bottom longitudinal edge of said ring of sides, said sheet being fixed to at least one of said bottom flaps which is covered, at least in part, by at least one other one of said bottom flaps is such a manner as to clamp said sheet between said flaps.

U.S. Pat. No. 5,356,028

Inventor: Erich Heuberger, et al.

Issued: Oct. 18, 1994

A preglued, flat folding box contains a section of tubular film glued to the box to form an inner bag. The tubular film section has bending lines in all four corners of the body of the folding box which extend to the edges of the section of tubular film. This makes it easier to erect the folding box containing the section of tubular film and to fill and close the package.

U.S. Pat. No. 6,006,917

Inventor: Loeffler Burkhard

Issued: Dec. 28, 1999

In a packaging unit for articles to be packed in a sterile condition, in order to reduce the risk of damage and, at the same time, to decrease the material requirement, it is proposed that it comprise an inner bag sealed in a gas tight manner which surrounds the article to be packed and encloses the article in a tight manner due to evacuation, a closed outer bag which receives the inner bag, and a shape-retaining frame which holds the outer bag immovably and is insertable into a shape-retaining storage container.

SUMMARY OF THE PRESENT INVENTION

A primary object of the present invention is to provide a packaging box that protects the object within.

Another object of the present invention is to provide a packaging box that is easily assembled.

Yet another object of the present invention is to provide a packaging box that contains a bubble wrap bag that is adhesively fixed to one interior wall of the box.

Still yet another object of the present invention is to provide a packaging box that contains a bubble wrap bag consisting of a tape strip and tie twists as means of closure, support and spacing from interior walls.

Yet another object of the present invention is to provide a packaging box that suspends a packed item within the interior of said box.

Additional objects of the present invention will appear as the description proceeds.

The present invention overcomes the shortcomings of the prior art by providing a packaging and storage box for shipping fragile articles, consisting of a corrugated housing containing a bag that is adhesively fixed to a first interior wall of the box and that substantially suspends the contents of the bag in a spaced away position from the remaining walls of the corrugated housing.

The bag can be constructed of any pliable shock absorbing material such as bubble wrap. The bag has an opening wherein an object can be placed. Fixedly positioned and extending adjacent the opening of the bag are tape elements with a peelably removable protective layer that is removed at the time of use to maintain the bag opening in a closed position about the article.

Additionally there are tie members fixedly positioned on the first interior wall. The material forms an additional bag support and spacing element being constructed of a pliable material having a malleable wire contained therein whereby the distal ends of said material can be twisted together as a final bag support and spacing method before the end flaps of the box are sealed.

The box is preferably shipped in a collapsed form until time of use. The bag is folded in a pleated fashion being contained within the collapsed walls along with the tape elements and tie members.

The following steps are performed in the assembly and packaging of the desired item which can be enclosed within a corrugated housing and substantially spaced away from the interior walls after packaging is completed. Step one: remove box from packaging. Step two: unfold the box until the opposing sides are parallel. Step three: fold each pair of opposing end flaps to form the bottom of the box and seal it with tape. Step four: stand box up, expand inner bag to engage all interior surfaces and place object within. Step five: fold the open end of the bag against the enclosed object, and secure with provided tape. Step six: grasp the ends of the tie members, join and twist until the enclosed article is secured. Step seven: fold the opposite end flaps to a closed position and secure with tape. Step eight: apply the shipping label provided, if applicable.

A packing container is provided for protecting an article, comprising: a rectangular carton having a first side, second side, third side, fourth side, each side having an interior surface, the carton having a top and a bottom, the top and bottom each having an interior surface; a flexible bag made from a shock-proofing material, the bag having a first end, the first end being attached to the carton first side interior surface, the bag further having an opening for inserting the article, the bag being closable about the article such that the closed bag is spaced from the second side, third side, fourth side, top and bottom, when the container is resting with the first side on top; a first tie member attached to and extending from the container first side; and a second tie member attached to and extending from the container first side, such that the bag, when closed about the article, can be bound by the first and second tie members, the first and second tie members being joinable such that the joined tie members can be tightened about said bag.

In another embodiment, the container top and container bottom are openable such that the container can be flattened before the article is placed in the bag.

In another embodiment, the bag is attached to the container first side with an adhesive.

In another embodiment, the bag is attached to the container first side by fasteners.

In another embodiment, the closing elements have protective coverings that are removable at the time of use.

In another embodiment, the closing elements are tape.

In another embodiment, the first and second tie members join on the container first side.

In another embodiment, the first and second tie members are independently attached on the container first side.

In another embodiment, the first and second tie members are attached to the container first side by adhesive.

In another embodiment, the first and second tie members are attached to the container first side by fasteners.

In another embodiment, the first and second tie members have a malleable member for joinder by twisting.

In another embodiment, the first and second tie members have a fastener for joining the tie members.

In another embodiment, for the bag closing the bag has a first closing element and a second closing element, the first and second closing element being joinable to close the bag.

In another embodiment, the first and second closing elements are attached to the bag.

In another embodiment, the first and second closing elements extend from the container first side.

In another embodiment, the first and second tie members are positioned in substantial alignment with the first and second closing elements.

In another embodiment, the first and second tie members are positioned in substantial disalignment with the first and second closing elements.

In another embodiment, the bag is made from bubble wrap material.

In another embodiment, the container further comprises tape sections for sealing the container bottom and the container top.

In one embodiment, a packing container is provided for protecting an article, comprising: a rectangular carton having a first side, second side, third side, fourth side, each side having an interior surface, the carton having a top and a bottom, the top and bottom each having an interior surface; a flexible bag made from an shock-proofing material, the bag, the bag being closable about the article; first means for supporting the bag such that the bag, when closed about the article, is spaced from the container second side, third side, fourth side, top and bottom, when the container is resting with the first side on top; and second means for supporting the bag such that the bag, when closed about the article, is spaced from the carton second side, third side, fourth side, top and bottom, when the container is resting with the first side on top.

In another embodiment, the first means comprises attaching the bag to the carton first side and the second means comprises a first tie member attached to and extending from the container first side, and a second tie member attached to and extending from the container first side, such that the bag, when closed about the article, can be bound by the first and second tie members, the first and second tie members being joinable such that the joined tie members can be tightened about said bag.

In one embodiment, there is provided a method for packing an article in a protective container, comprising the steps of: closing a bottom side of the container, the container having a first side, second side, third side, fourth side, each side having an interior surface, the container also having a top side; opening the top side of the container; opening a flexible bag made from a shock-proofing material, the bag having a first end, the first end being attached to the carton first side interior surface; inserting the article into the flexible bag; closing the flexible bag about the article; wrapping a first tie member attached to and extending from the container first side, and a second tie member attached to and extending from the container first side, such that when the first and second tie members are joined, the bag, when closed about the article, is spaced apart from the container second, third, fourth, top and bottom sides, when the container is resting such that the container top side is facing up; closing the container top side.

In another embodiment, an additional step is added wherein, prior to closing the bottom side, the container is expanded from a flattened configuration into a rectangular configuration.

In another embodiment, an additional step is added wherein shipping labels are applied to the container.

In another embodiment, an additional step is added wherein, after closing the container top side, the container is positioned such that the first side on top.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim

BRIEF DESCRIPTION OF THE DRAWING FIGURES

FIG. 1 is an illustrative view of the present invention in use. The packaging box of the present invention consists of a corrugated housing with bottom-side and top-side panels. Within the housing, a bubble wrap bag is adhesively fixed to one interior wall of the box. The bubble wrap bag consists of closure tape elements and tie members. When an object is placed within the box and sealed, it is suspended within the housing of the box and within the sealed bubble wrap inner bag.

DESCRIPTION OF THE REFERENCED NUMERALS

Figure 1:
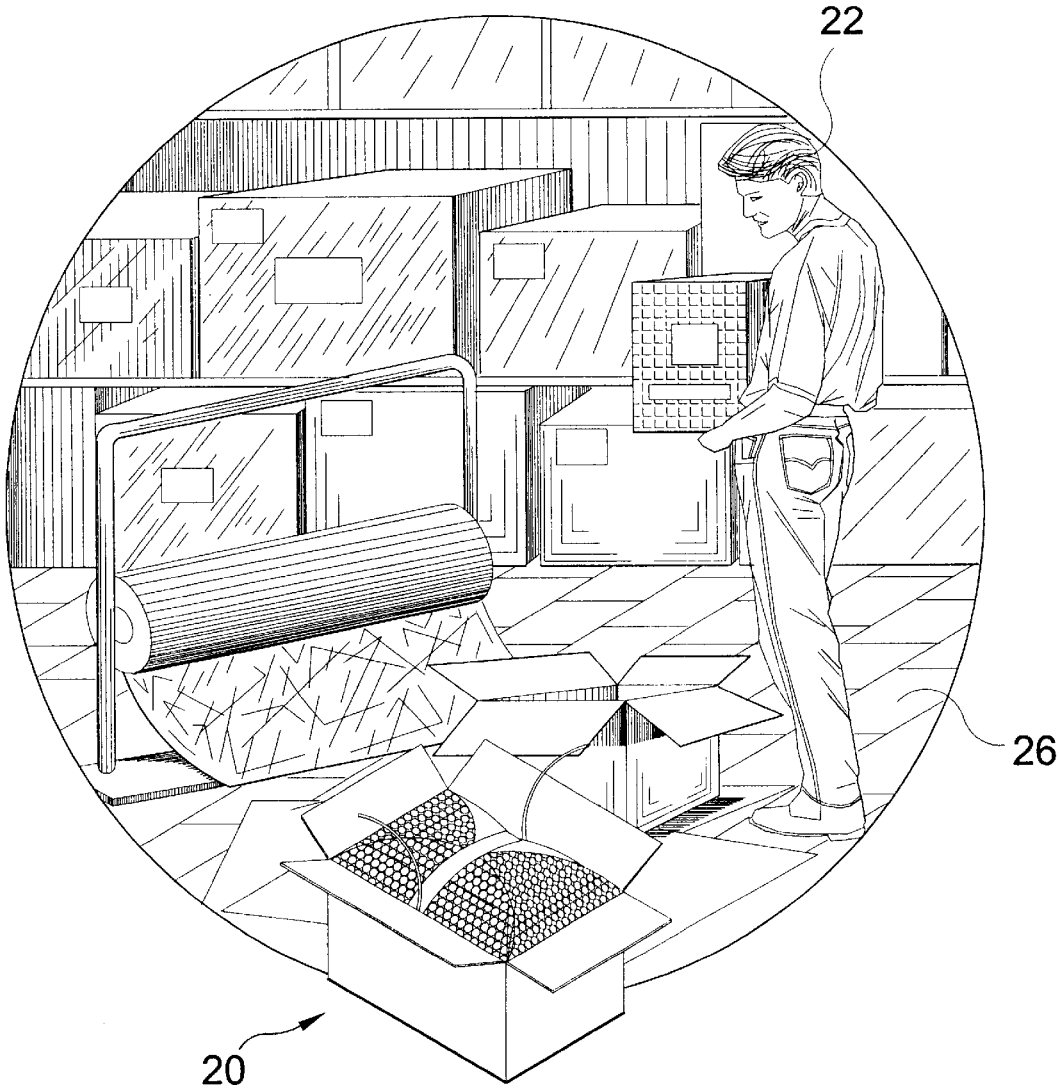

Turning now descriptively to the drawings, in which similar reference characters denote similar elements throughout the several views, the figures illustrate the Packaging Box of the present invention. With regard to the reference numerals used, the following numbering is used throughout the various drawing figures.

20 Packaging box of the present invention
22 user
24 packaged article
26 floor surface
28 sealing tape
30 top-side panels
32 bottom-side panels
34 top-side panels interior surfaces
36 bottom-side panels interior surfaces
40 box first side
42 box second side
44 box third side
46 box fourth side
50 box first side interior surface
52 box second side interior surface
54 box third side interior surface
56 box fourth side interior surface
60 inner bag
62 inner bag tape elements
64 inner bag first end
66 adhesive
70 tie member first end
72 tie member second end
74 tie member knot
76 shipping label
100 alternate embodiment
200 step one
202 step two
204 step three
206 step four
208 step five
210 step six
212 step seven
214 step eight

DETAILED DESCRIPTION OF THE PREFERRED EMBODIMENT

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

FIGS. 1–10 depict the packaging box 20 in its preferred embodiment, being utilized by user 22 for a fragile article 24, the packaging box 20 resting on a typical floor surface 26.

Figure 2:
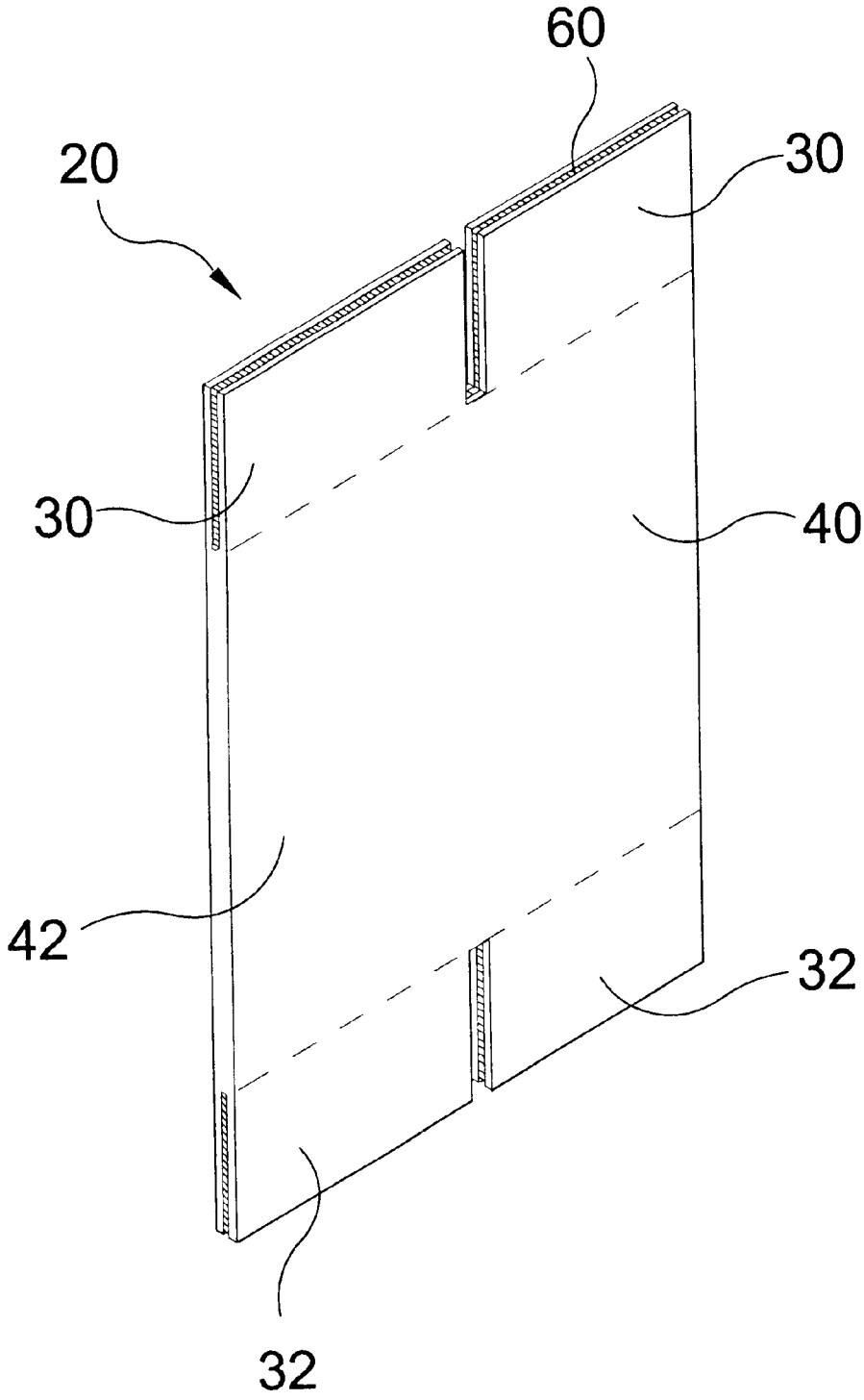
FIG. 2 is a perspective view of the box of the present invention, wherein the packaging box is depicted in its original flattened configuration.
Figure 3:
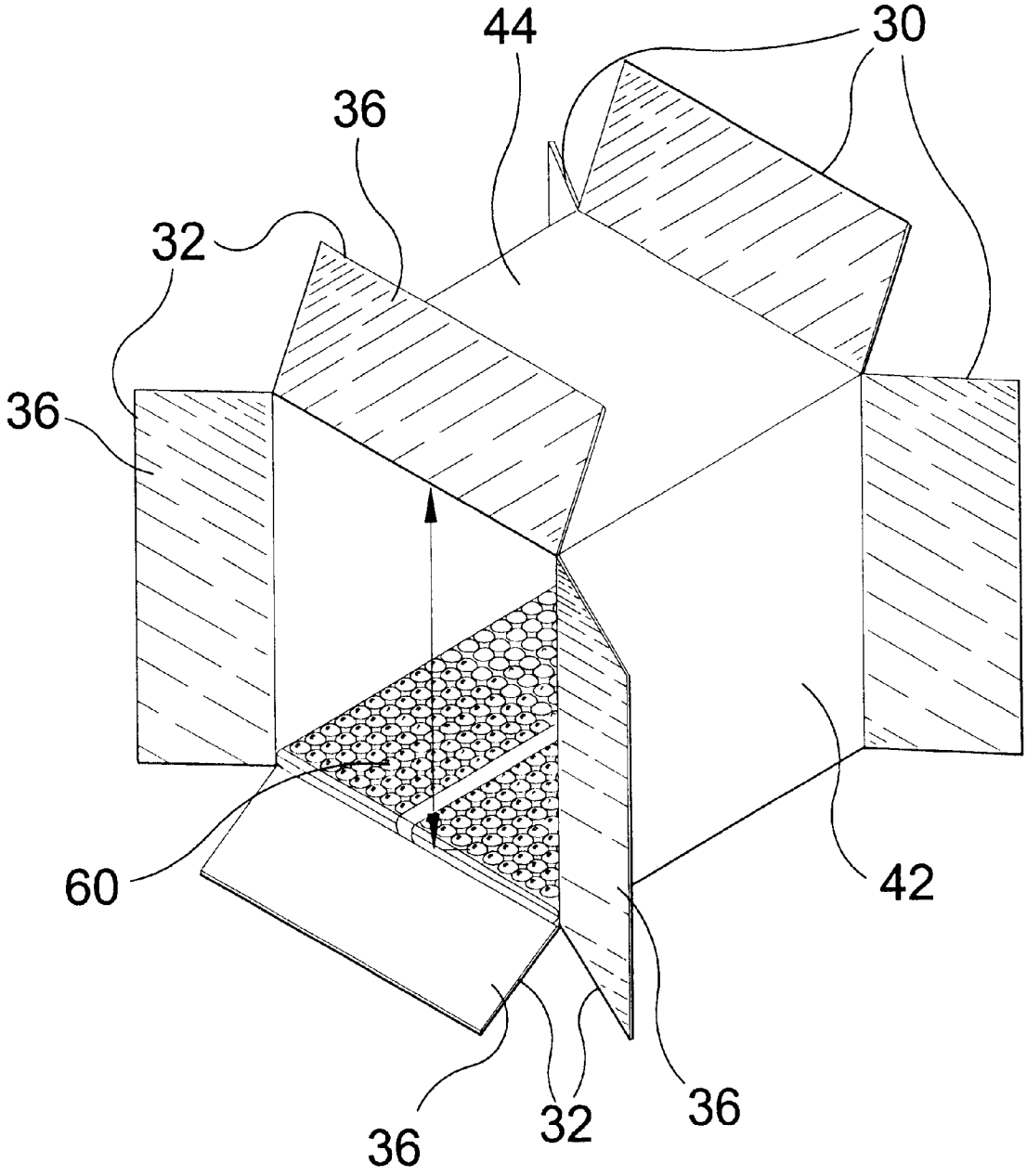
FIG. 3 is a perspective view of the present invention depicting the box being conformed to the rectangular shape.
Figure 4:
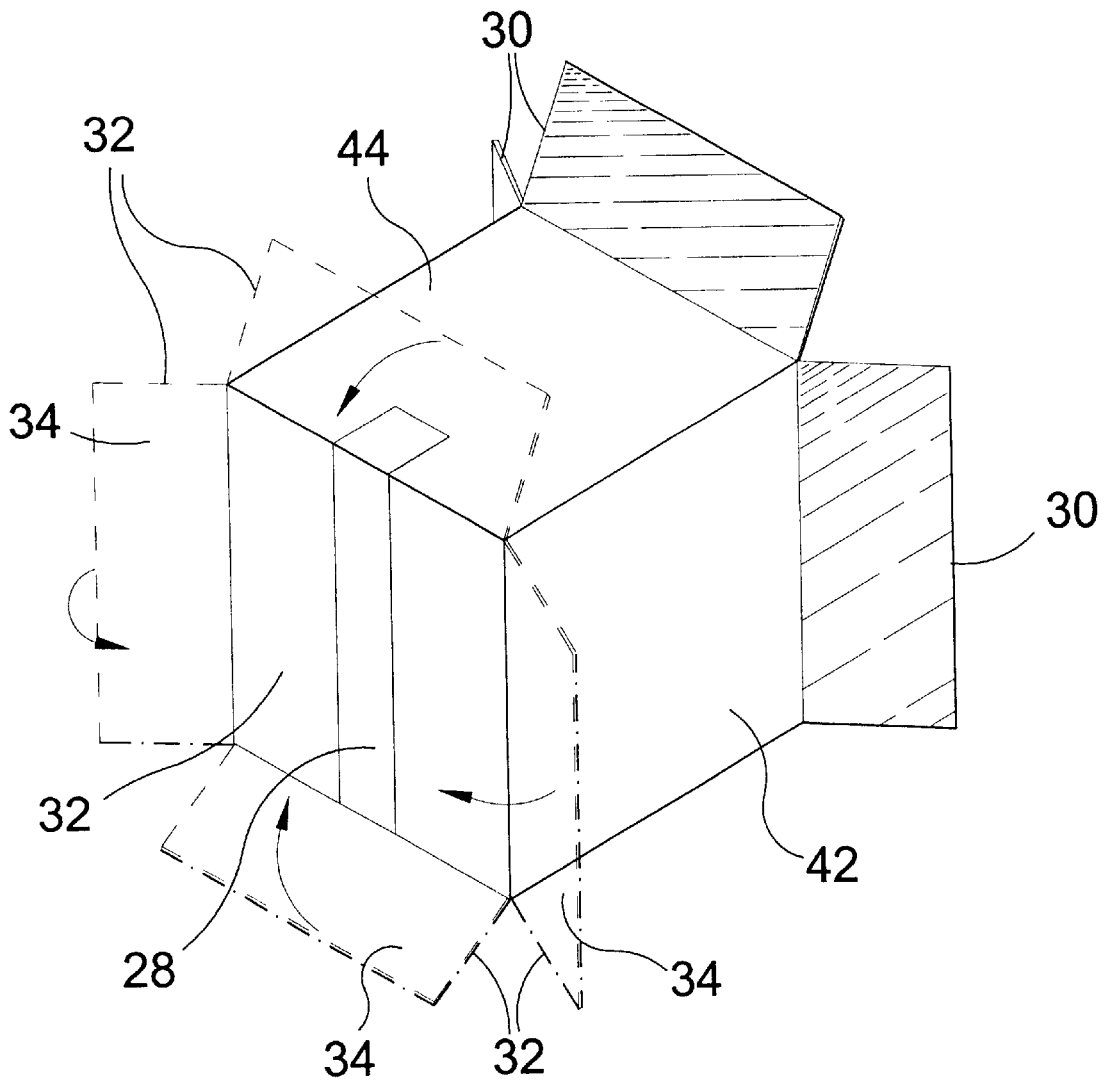
FIG. 4 is a perspective view of the present invention depicting the closure and taping of the bottom-side panels.

As shown in FIGS. 2–4 the top-side panels 30 and bottom-side panels 32 allow the packaging box 20 to be received in a flattened configuration that is readily expandable to a rectangular configuration such that bottom-side panels 32 can be closed and taped using conventional strapping tapes 28. The top-side panels 30 have interior surfaces 34 and the bottom-side panels 32 have interior surfaces 36, as shown in FIG. 3 and FIG. 5, respectively.

Figure 9:
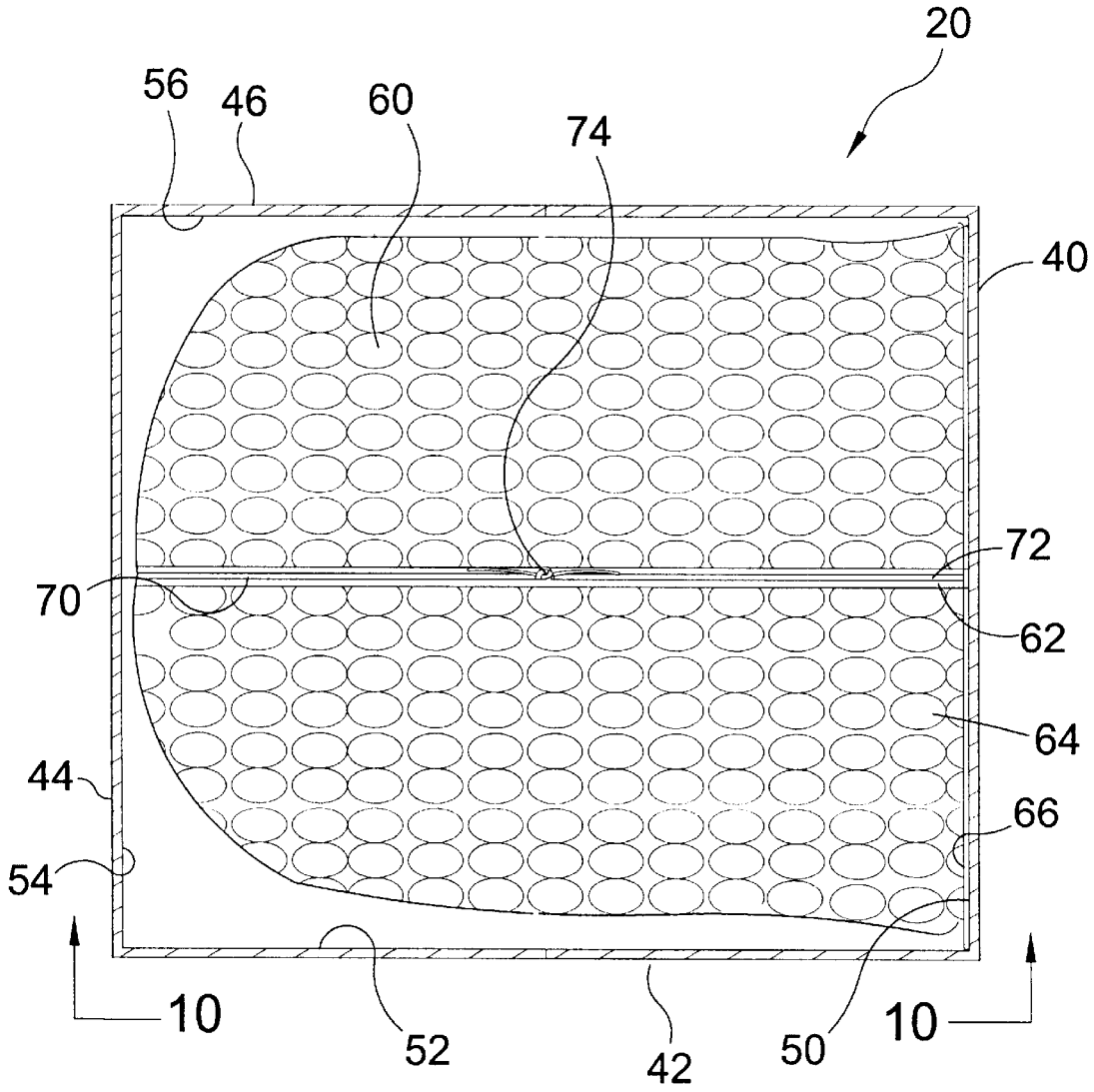
FIG. 9 is a sectional top view of the present invention depicting the interior of the sealed box with the bubble wrap containing the article within.
Figure 10:
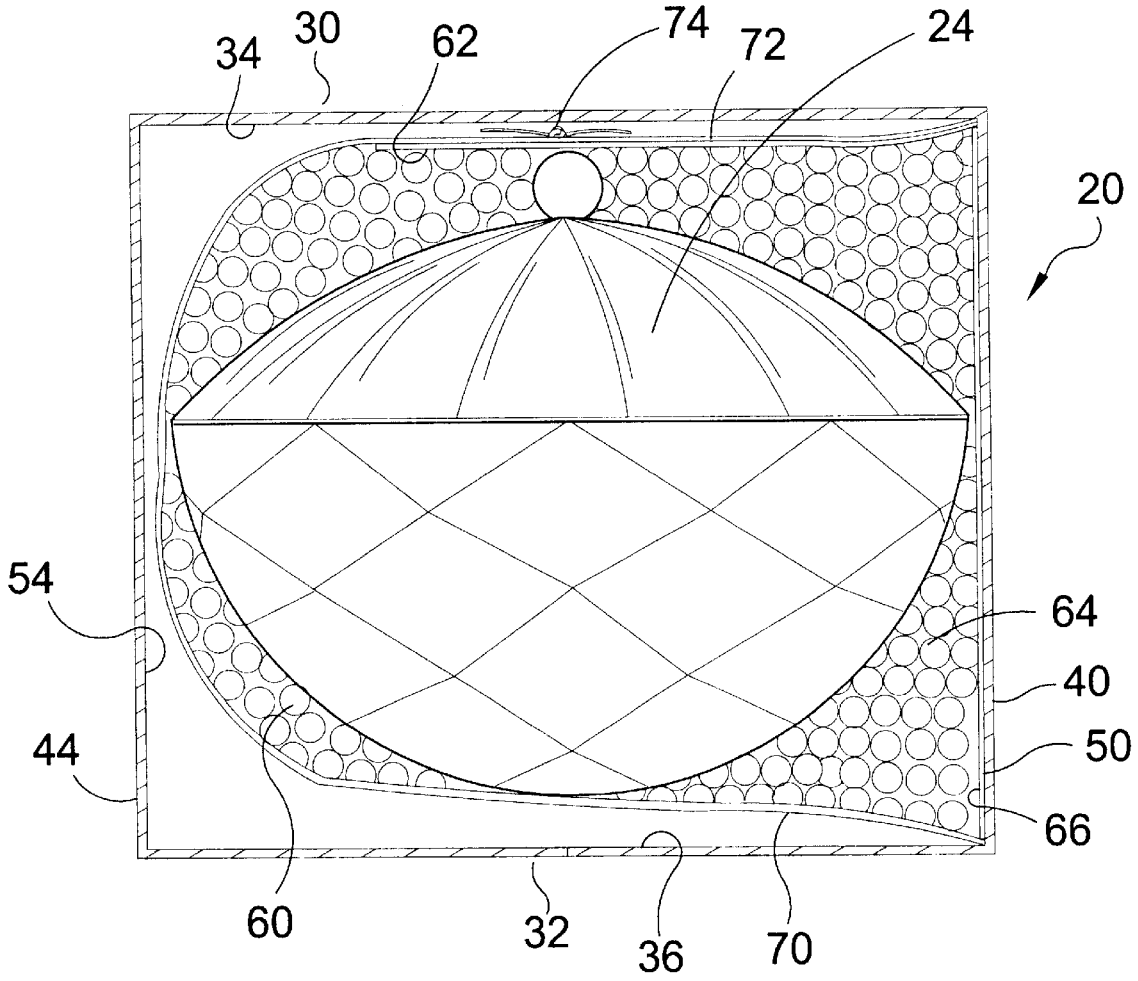
FIG. 10 is a sectional side view of the present invention depicting the article within the inner bag and the inner bag suspended from the first side interior wall.

As shown in FIG. 9, the packaging box 20 has a first side 40, a second side 42, a third side 44, and a fourth side 46. The first side 40 has an interior surface 50, the second side 42 has an interior surface 52, the third side 44 has an interior surface 54, and the fourth side 46 has an interior surface 56. The sides 40,42,44,46 and panels 30,32 are made from conventional box materials such as cardboard and the like.

Figure 5:
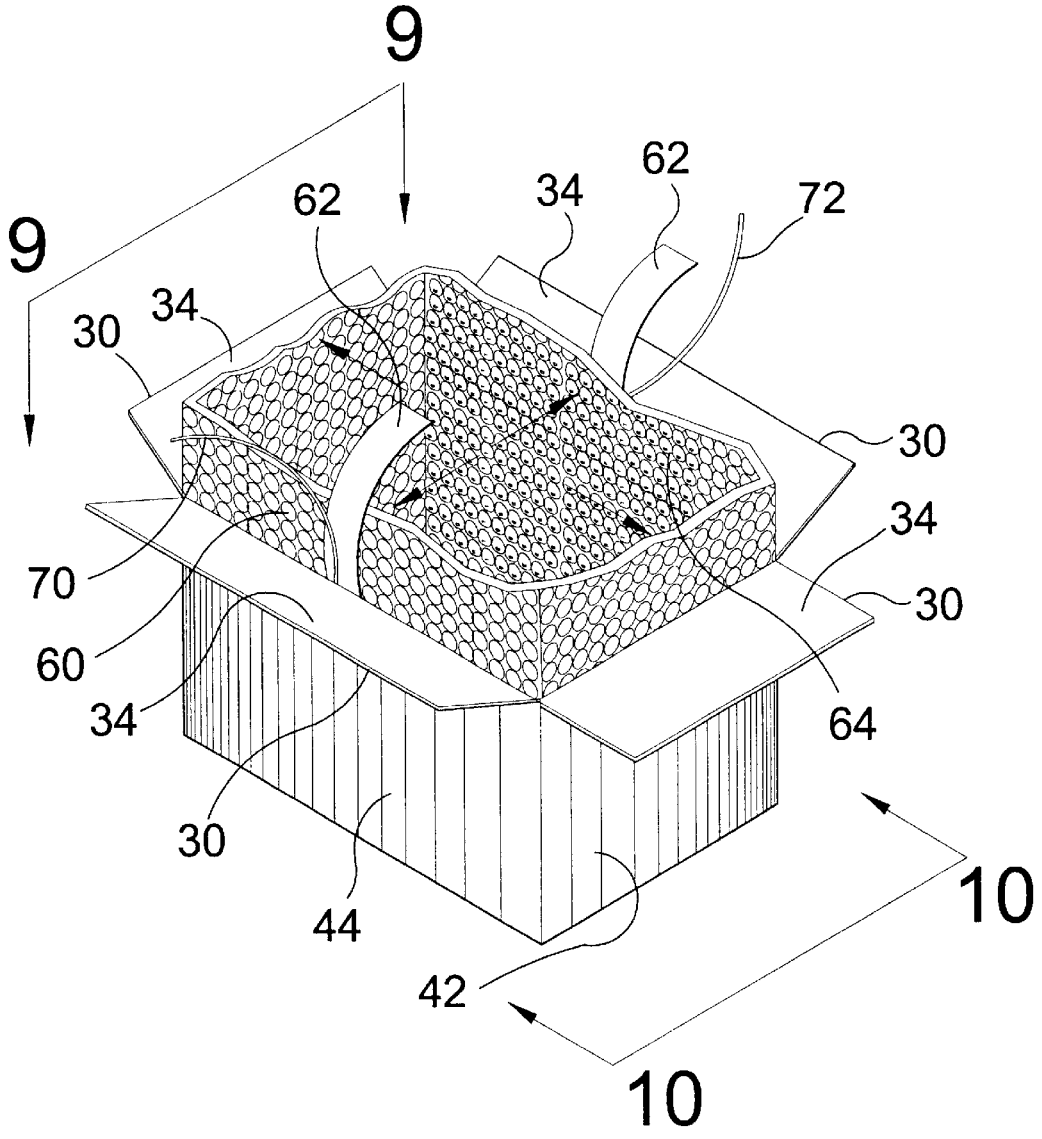
FIG. 5 is a perspective view of the present invention depicting the expansion of the inner bag with its opening ready for the insertion of the article.
Figure 6:
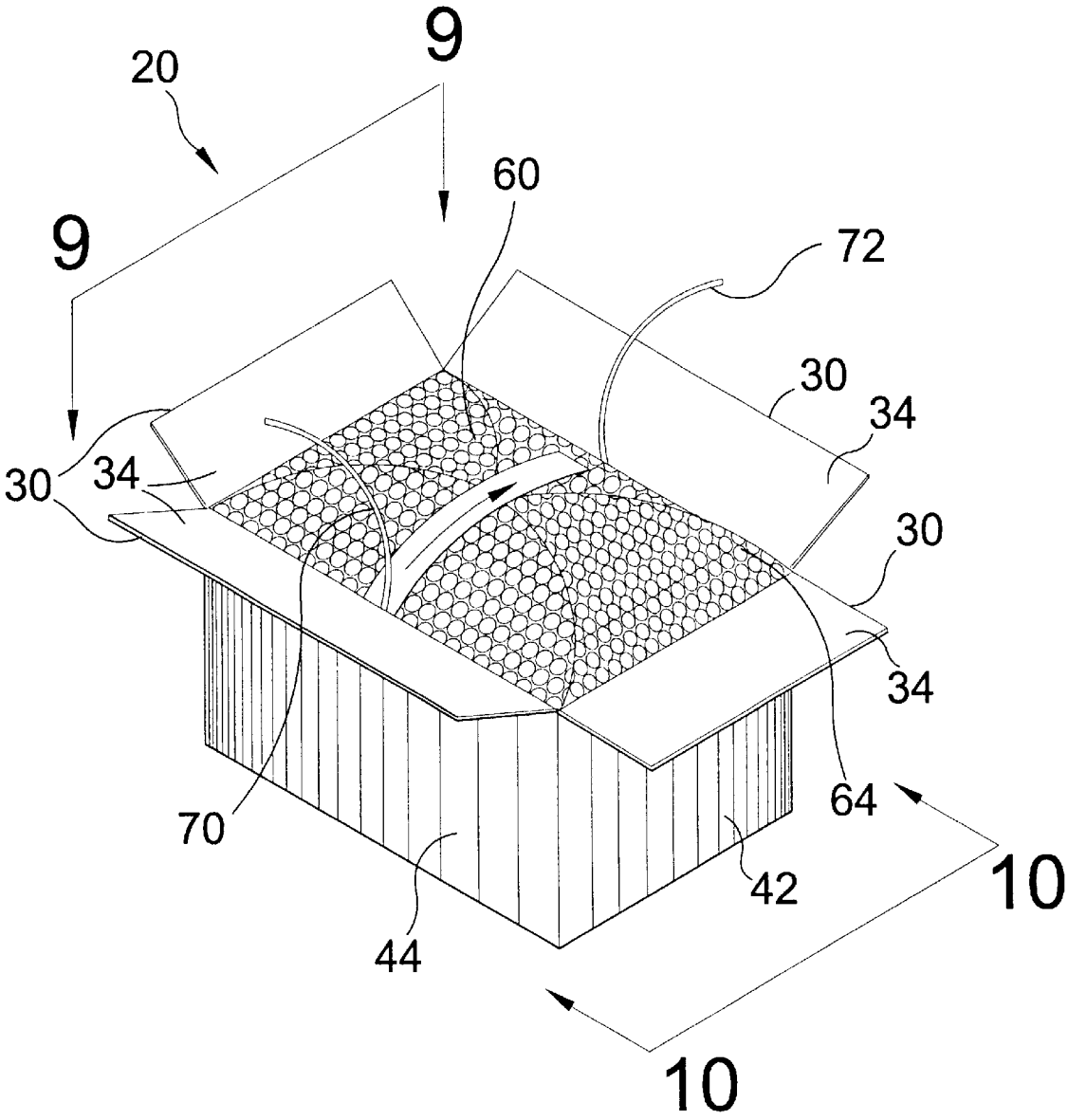
FIG. 6 is a perspective view of the present invention depicting the closure of the inner bag about the article with the tape elements.
Figure 7:
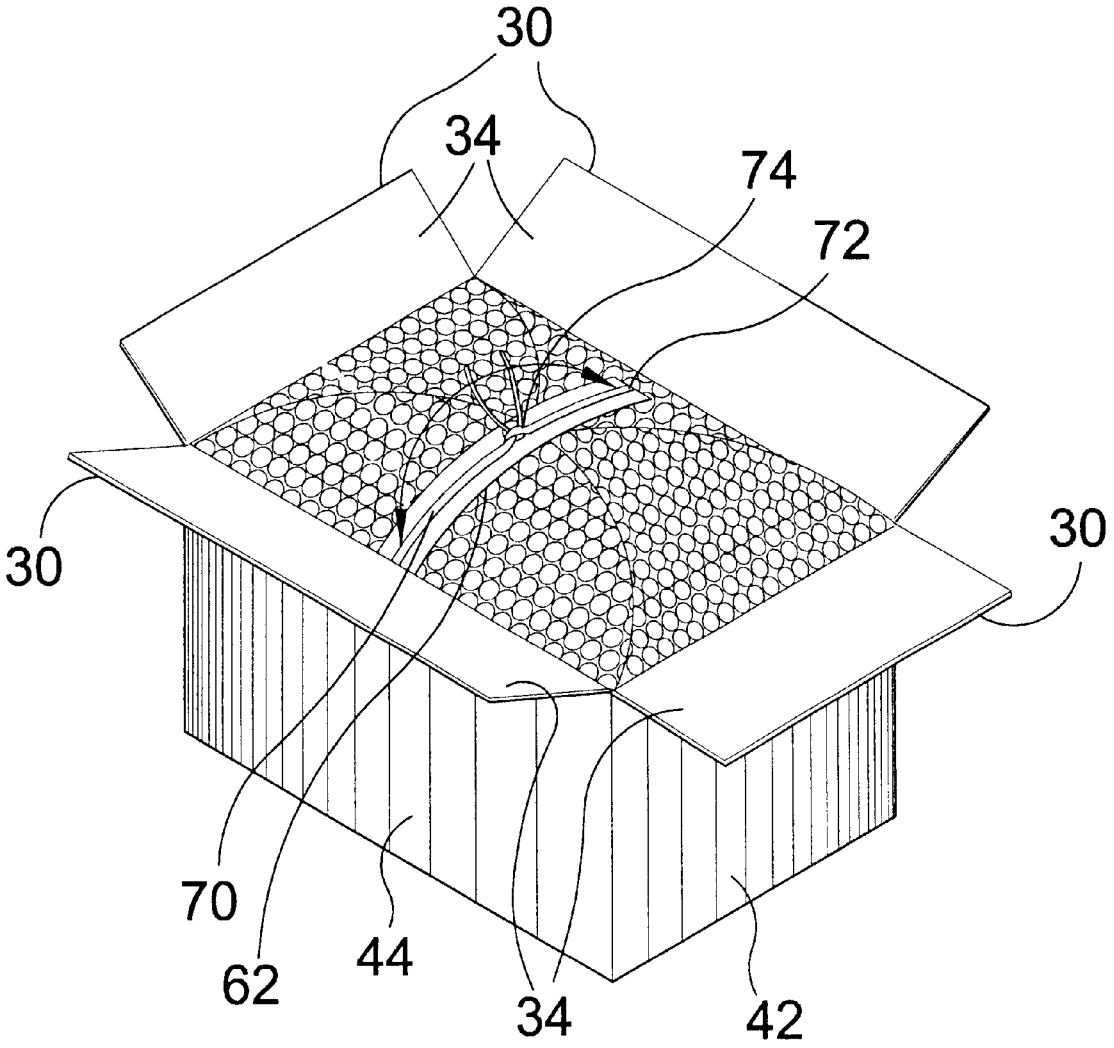
FIG. 7 is a perspective view of the present invention depicting the joinder of the tie members into a twist knot that has been tightened about the inner bag.
Figure 8:
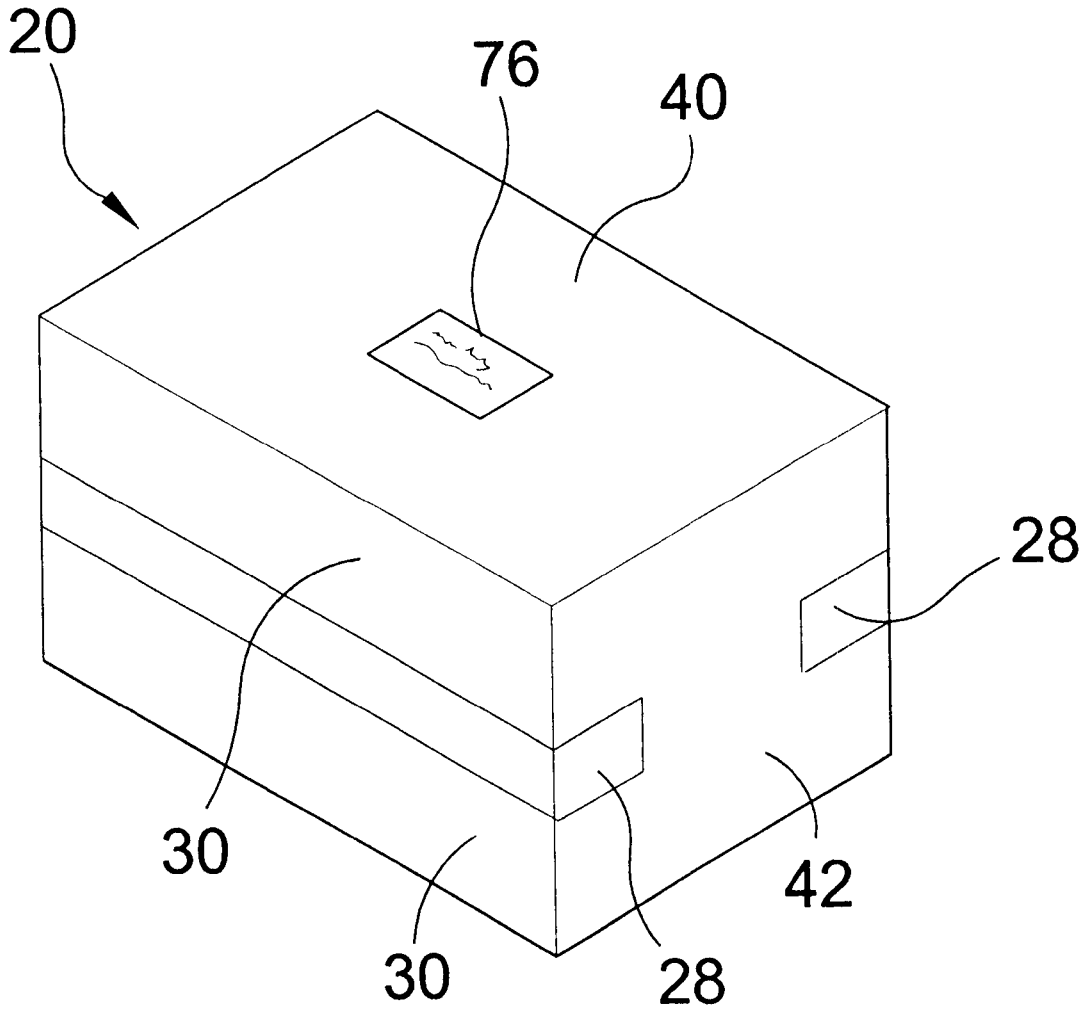
FIG. 8 is a perspective view of the present invention depicting the closure and taping of the top-side panels, and the placement of the box with the first side up for vertical hang and suspension of the inner bag.

An inner bag 60 is provided in the packaging box, first in a flattened configuration and then expanded, as shown in FIG. 3 and FIG. 5, respectively. When expanded the inner bag 60 opens to provide access for placing the article 24, and has two tape elements 62 attached to the inner bag 60 that are used to close and seal the inner bag 60 after the article has been inserted, as depicted in FIG. 6. The inner bag 60 is made from conventional "bubble" packing material, although other impact-resistant, shock-proofing, cushioning materials can also be utilized. The tape elements 62 have peelable protective coverings that are removed at the time the inner bag 60 is to be closed.

As shown in FIG. 9, the inner bag has a first end that is attached by adhesive 66 to the first side interior surface 50.

A first tie member 70 and a second tie member 72 are attached to the first side interior surface 50 and are positioned and sized to circumvent and bind the inner bag 60 as shown in FIGS. 5–7 and FIG. 10. The first tie member 70 is longer such that it circumvents the inner bag 60 with enough length to overlap, join and be twisted with the second tie member 72 to form a knot 74. As the twisting continues the combined length of the first and second tie members 70,72 is shortened thus drawing the inner bag 60 closer to the first side interior surface 50, and farther from the third side interior surface 54, the bottom-side panels interior surfaces 36, and the top-side panels interior surfaces 34, the top-side panels 30 being closed and sealed at the end of the packaging method.

The tie members 70,72 in the preferred embodiment of the packaging box 20, include a malleable inner wire that is ideal for the twisting and tightening function. Other elongated materials, including those requiring a fastener to secure the first tie member 70 to the second tie member 72 in a tight or tightenable configuration are also contemplated. In the preferred embodiment of the packaging box 20 the tie members 70,72 are attached to the first side interior surface by adhesives, although staples, tape, and other fasteners can also be used for this purpose. In this embodiment the tie members 70,72 are joined on the first side interior surface 50 to form a continuous member, although each can be separate in other embodiments.

Figure 11:
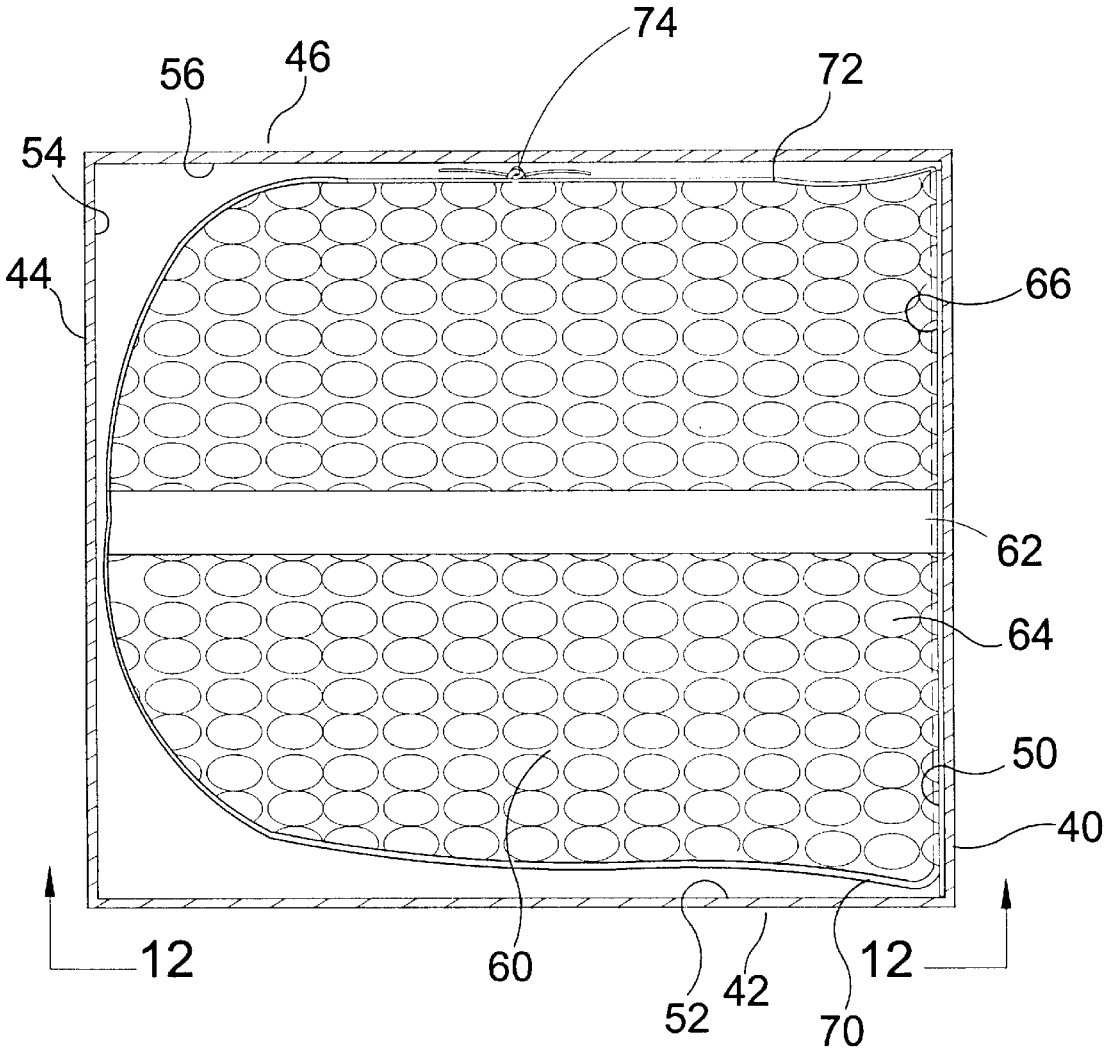
FIG. 11 is a sectional top view depicting an alternate routing of the tie members such that the tie members are not aligned with the tape elements.
Figure 12:
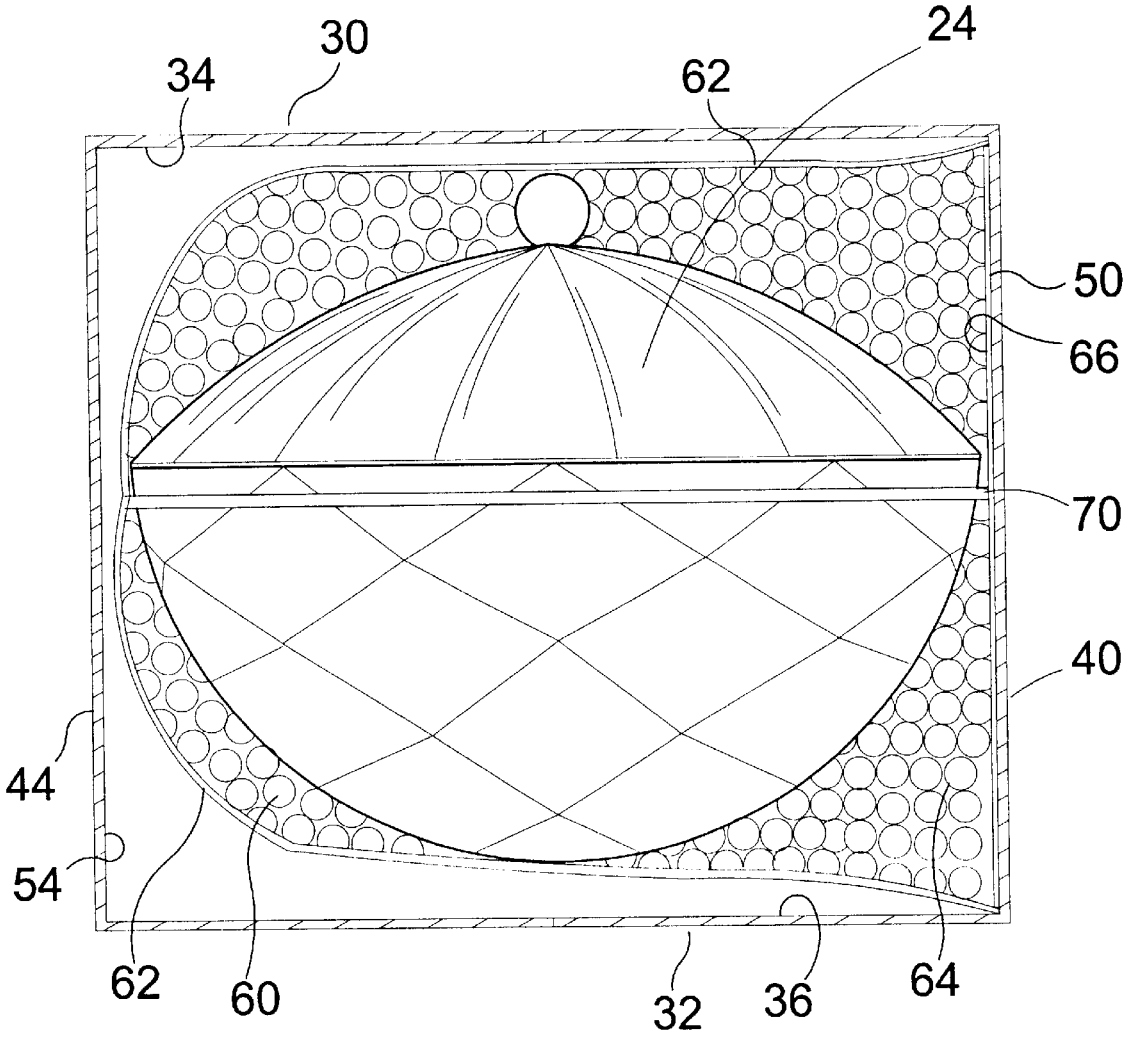
FIG. 12 is a sectional side view of the embodiment with an alternate routing of the tie members.

In the preferred embodiment of the packaging box 20, the tie members 70,72 align with the tape elements 62. In another embodiment 100, shown in FIGS. 11–12, the tie members 70,72 are shifted such that the tie members 70,72 are not aligned with the tie elements 62. In this embodiment 100, the tape elements 62 extend from the first side interior surface 50 to form a continuous supporting member about the inner bag 60, thus serving to close and support the inner bag 60 and the article 24 within.

Figure 13:
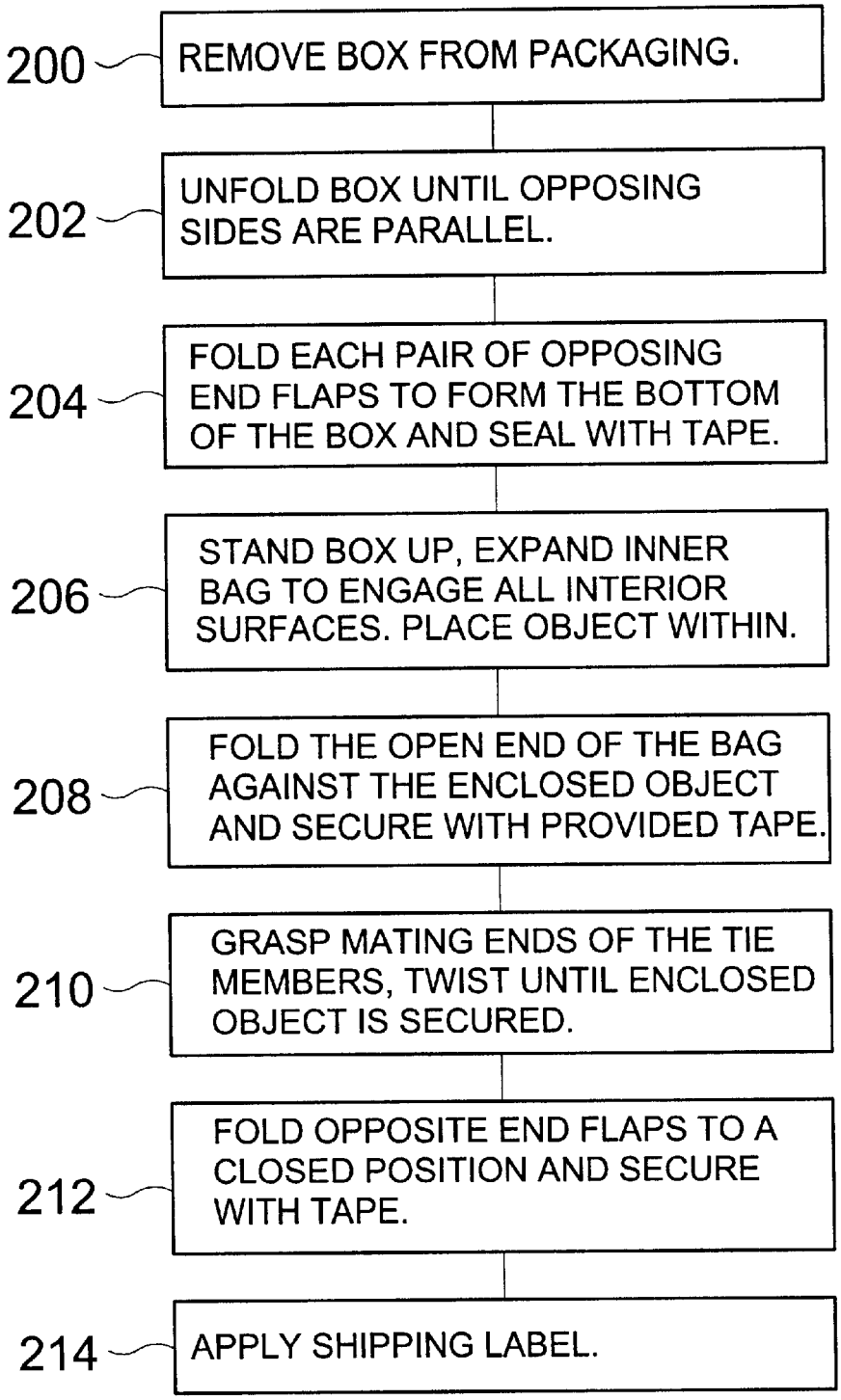
FIG. 13 is a block diagram depicting the method steps of the present invention.

FIG. 13 is a block diagram describing the steps involved in securing a fragile article 24 in the packaging box 20.

The user 22 first removes the packaging box 20 from its own packaging 200. The packaging box 20 is then unfolded until opposite sides 40,42,44,46 are parallel 202. The bottom-side panels 32 are then folded and taped 204.

Once a bottom has been formed the inner bag 60 is expanded and the article 24 is inserted 206. In the preferred embodiment of the packaging box 20, the inner bag 60 is sized to allow expansion to all or substantially all of the interior surfaces 52,54,56,36, although smaller inner bags 60 are also contemplated. The inner bag 60 is then folded about the article 24 until the article is completely encompassed by the inner bag 60, and then the tape elements 62 are joined to close the inner bag 60, thus securing the article 24 within 208.

A properly closed inner bag 60 will result in the inner bag 60 being spaced from all interior surfaces 52,54,56,34,36 when the packaging box 20 is closed and the third side 44 is placed on the floor surface 26, leaving the first side 40 facing up. Additional support for the inner bag 60 and an additional means to ensure such spacing is provided by grasping the tie members 70,72, joining them into a twist knot 74 and twisting until the joined tie members 70,72 are tight 210. This causes the joined tie members 70,72 to be tight about the inner bag 60 thus contributing to the desired spacing from the interior surfaces 52,54,56,34,36.

Once the tie members 70,72 have been joined and tightened, the user 12 folds the top-side panels 30 and uses conventional tape 28 to complete the seal 212.

The shipping label is then applied 214 and the packaging box 20 is ready for shipment. The preferred orientation for the packaging box 20 during shipping is with the third side 40 facing up, although the benefits of the supported and suspended inner bag 60 remain present to a large degree regardless of orientation.

With respect to the above description then, it is to be realized that the optimum material and dimensional relationships for the parts of the packaging box 20, will include variations in size, materials, shape, and form, which will occur to those skilled in the art upon review of the present disclosure. All equivalent relationships to those illustrated in the drawings and described in the specification are intended to be encompassed by the present invention..

What is claimed as new and desired to be protected by Letters Patent is set forth in the appended claims:

1. A packing container for protecting an article, comprising:

a rectangular carton having a first side, second side, third side, fourth side, each side having an interior surface, the carton having a top and a bottom, the top and bottom each having an interior surface;

a flexible bag made from a shock-proofing material, the bag having a first end, the first end being directly attached to the carton interior surface of the first side, the bag further having an opening for inserting the article, the bag being closable about the article such that the closed bag is spaced from the second side, third side, fourth side, top and bottom, when the container is resting with the first side on top;

a first tie member attached to and extending from the container first side; and a second tie member attached to and extending from the container first side, such that the bag, when closed about the article, can be bound by the first and second tie members, the first and second tie members being joinable such that the joined tie members can be tightened about said bag.

2. The container of claim 1, wherein the container top and container bottom are openable such that the container can be flattened before the article is placed in the bag.

3. The container of claim 1, wherein the bag is attached to the container first side with an adhesive.

4. The container of claim 1, wherein the bag is attached to the container first side by fasteners.

5. The container of claim 1, wherein the container also comprises closing elements that have protective coverings that are removable at the time of use.

6. The container of claim 1, wherein the container also comprises closing elements that are tape.

7. The container of claim 1, wherein the first and second tie members join on the container first side.

8. The container of claim 1, wherein the first and second tie members are independently attached on the container first side.

9. The container of claim 1, wherein the first and second tie members are attached to the container first side by adhesive.

10. The container of claim 1, wherein the first and second tie members are attached to the container first side by fasteners.

11. The container of claim 1, wherein the first and second tie members include a malleable component for joinder by twisting.

12. The container of claim 1, wherein the first and second tie members have a fastener for joining the tie members.

13. The container of claim 1, wherein for the bag closing the bag has a first closing element and a second closing element, the first and second closing element being joinable to close the bag.

14. The container of claim 13, wherein the first and second closing elements are attached to the bag.

15. The container of claim 13, wherein the first and second closing elements extend from the container first side.

16. The container of claim 13, wherein the first and second tie members are positioned in substantial alignment with the first and second closing elements.

17. The container of claim 13, wherein the first and second tie members are positioned in substantial disalignment with the first and second closing elements.

18. The container of claim 1, wherein the bag is made from bubble wrap material.

19. The container of claim 1, wherein the container further comprises tape sections for sealing the container bottom and the container top.

20. A packing container for protecting an article, comprising:

a rectangular carton having a first side, second side, third side, fourth side, each side having an interior surface, the carton having a top and a bottom, the top and bottom each having an interior surface;

a flexible bag made from an shock-proofing material, the bag being closable about the article, and the first end of the bag being directly attached to the carton interior surface of the first side;

first means for supporting the bag such that the bag, when closed about the article, is spaced from the container second side, third side, fourth side, top and bottom, when the container is resting with the first side on top; and second means for supporting the bag such that the bag, when closed about the article, is spaced from the carton second side, third side, fourth side, top and bottom, when the container is resting with the first side on top.

21. The container of claim 20, wherein the first means comprises attaching the bag to the carton first side and the second means comprises a first tie member attached to and extending from the container first side, and a second tie member attached to and extending from the container first side, such that the bag, when closed about the article, can be circumscribed by the first and second tie members, the first and second tie members being joinable such that the joined tie members can be tightened about said bag.

22. A method for packing an article in a protective container, comprising the steps of:

providing a container having a first side, second side, third side, fourth side, each side having an interior surface, the container also having a top side and a bottom side;

closing the bottom side of the container;

opening the top side of the container;

opening a flexible bag made from a shock-proofing material, the bag having a first end, the first end being directly attached to the carton interior surface of the first side;

inserting the article into the flexible bag; closing the flexible bag about the article;

wrapping a first tie member attached to and extending from the container first side, and a second tie member attached to and extending from the container first side, such that when the first and second tie members are joined, the bag, when closed about the article, is spaced apart from the container second, third, fourth, top and bottom sides, when the container is resting such that the container top side is facing up;

closing the container top side.

23. The container of claim 22, wherein, prior to closing the bottom side, the container is expanded from a flattened configuration into a rectangular configuration.

24. The container of claim 22, wherein shipping labels are applied to the container.

25. The container of claim 22, wherein, after closing the container top side, the container is positioned such that the first side on top.

* * * * *